United States Patent [19]

Webb et al.

[11] Patent Number: 4,746,159

[45] Date of Patent: May 24, 1988

[54] COMBINATION SKI AND BOOT BAG

[76] Inventors: Rod P. Webb, 1629 Carlisle, Oklahoma City, Okla. 73120; Jean Webb, 1518 Wildwood Ct., Stillwater, Okla. 74075

[21] Appl. No.: 83,237

[22] Filed: Aug. 10, 1987

[51] Int. Cl.[4] ..... A63C 11/00; B65B 11/00

[52] U.S. Cl. ..... 294/147; 280/814; 150/52 R; 224/917

[58] Field of Search ..... 294/147, 141, 159, 163; 150/52 R; 280/814; 224/324, 917; D3/36

[56] References Cited

U.S. PATENT DOCUMENTS

| | | | |
|---|---|---|---|
| D. 199,296 | 9/1964 | Kallman . | |
| 2,250,388 | 7/1941 | Mickelberg . | |
| 3,259,284 | 7/1966 | Olson . | |
| 3,336,961 | 8/1967 | Welsh . | |
| 3,767,036 | 10/1973 | McLeod . | |
| 3,909,031 | 9/1975 | Schmaedeke et al. | 294/147 |
| 3,917,137 | 11/1975 | Wilkins . | |
| 4,191,233 | 3/1980 | McKay . | |
| 4,358,137 | 11/1982 | Gramm | 294/147 |
| 4,674,787 | 6/1987 | De Vera | 294/147 |

*Primary Examiner*—James B. Marbert

*Attorney, Agent, or Firm*—Laney, Dougherty, Hessin & Beavers

[57] ABSTRACT

A combination ski and boot bag which includes a centrally located elongated ski compartment for containing a pair of skis and poles, and which further includes a pair of laterally disposed, horizontally spaced boot compartments secured to opposite sides of the central portion of the ski compartment. Strap means are provided on the upper side of the central portion of the ski bag to facilitate hand carriage of the ski and boot bag.

14 Claims, 3 Drawing Sheets

COMBINATION SKI AND BOOT BAG

FIELD OF THE INVENTION

This invention relates to a combination ski and boot bag which can be utilized for simultaneously transporting a pair of skis, ski poles and a pair of ski boots, or other paraphernalia, and which can be folded into a compact form, either when nothing is carried in the bag, or when the skis are not carried in the ski compartment forming a part of the bag.

BRIEF DESCRIPTION OF THE PRIOR ART

U.S. Pat. No. 4,191,233 issued to Gordon McKay is directed to horizontally spaced covers provided for skis and having hand straps secured to the covers, and having zippers for providing access to the interior of the covers and removal of the skis. In the center of the structure between the two covers for the skis is located at the opposite sides thereof. These slide fasteners function to detachably engage the two ski cover assemblies to the centrally located storage bag. A hand carrying strap is also secured to the upper side of the central storage bag.

Although they are individually protected by the ski covers of the McKay patent, the skis can still bang around and can slam against each other in the space provided between the ski covers. This space is required in order to accommodate the storage bag and it allows objects to pass between the two skis located in their respective covers, and to cause damage to the structure.

It is difficult to fold the McKay twin ski cover structure with a centrally located storage bag into a compact status in which all of the elements of the structure remain interengaged with each other.

Wilkins U.S. Pat. No. 3,917,137 is of interest in its depiction and description of a carrying case 10 in which a pair of ski boots 12 can be carried, and which can also be used for securing in close proximity to the ski boot compartment, a pair of skis, as well as a pair of ski poles. The container for the ski boots can be carried by a handle, or by means of a shoulder strap. The boot case provided in the Wilkins structure is rigid, and the skis are clamped into slots formed beneath the rigid, boot case. Flexible covers are used to cover the end portions of the skis, and these covers are snap-engaged with the rigid boot case.

McLeod U.S. Pat. No. 3,767,036 describes an elongated container in which a pair of skis and ski boots can be contained. The container includes two halves which are hinged together, and is provided with restraining means which are configured to receive skis and boots. Both the boots and the skis in the McLeod structure are carried in two rigid container halves which are sufficiently long to contain and accommodate the skis, and which are hingedly interconnected along one longitudinal edge of each of the two rigid case halves.

A need exists for a flexible, light-weight, combination carrying case in which both skis, ski poles and boots or other paraphernalia can be easily transported to a location of use, and which can be collapsed to a compact status when not in use.

GENERAL DESCRIPTION OF THE PRESENT INVENTION

The present invention is a bag for concurrently storing and/or carrying skis, ski poles and boots, using hand straps or a shoulder strap for carriage. The bag can be placed in a relatively compact configuration in which the compartment for the skis is folded up and placed between the pockets or compartments provided for the boots at a time when the bag is not in use for containing skis.

Broadly described, the ski and boot bag of the invention includes an elongated, centrally located, flexible compartment in which a pair of skis and ski poles can be enclosed for carrying or for storage. At the opposite sides of the ski compartment are a pair of boot compartments, one for each boot of a pair of boots, with enough space for additional paraphernalia. Alternatively, each boot compartment may be utilized to contain a pair of boots. Both the ski compartment and the compartments for the boots have access zippers or fasteners disposed on the upper sides thereof, and at the upper side of the ski compartment a pair of handles is secured and facilitates the hand carrying of the ski and boot bag. An elongated shoulder strap is detachably connected at its opposite ends to short straps secured at longitudinally spaced positions along the ski bag.

In one embodiment of the invention, the lateral boot compartments are quick detachably connected to the elongated, centrally located ski compartment, and either or both can be removed from the ski compartment quickly and easily if desired. Another embodiment of the invention contemplates that the two opposed or lateral boot compartments can be pulled together beneath the ski compartment and there secured to each other to reduce the bulk and enhance the compactness of the ski-boot bag combination, and to provide an internal space for storing the ski compartment when it is not in use.

An important object of the present invention is to provide a combination ski and boot bag which can be used to easily concurrently carry both a pair of skis and a pair of ski boots, in the same combination bag which will accommodate both simultaneously, and do so while in a compact configuration which facilitates immediate and easy access to either the skis or to the boots, or to both, at any time desired.

Another object of the invention is to provide an elongated, flexible ski compartment having a pair of opposed boot compartments located on opposite sides of the ski compartment and arranged so that the assembly can be carried on the shoulder by means of an elongated shoulder strap, or by hand by means of hand straps, and when set upon the floor or a horizontally extending surface, disposed access zippers or fasteners in an upwardly facing position so that the skis and boots contained in the bag compartments can be readily retrieved and made ready for use.

A further object of the invention is to provide a combination ski and boot bag which, when skis are not being carried in the ski compartment thereof, permits the ski compartment to be folded into an interior position within and between the boot compartments, and the entire combination thereby made compact and more easily stored in a relatively small space.

Additional objects and advantages of the present invention will become apparent as the following detailed description of specific embodiments of the invention is read in conjunction with the accompanying drawings.

GENERAL DESCRIPTION OF THE DRAWINGS

DETAILED DESCRIPTION OF THE PREFERRED EMBODIMENTS OF THE INVENTION

Figure 1:
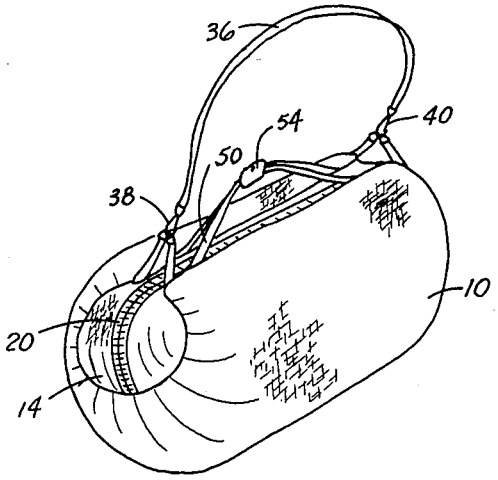
FIG. 1 is a perspective view of one embodiment of the combination ski and boot bag of the invention, showing the combination bag with the ski compartment folded within the pair of boot compartments for compact storage of the assembly.
Figure 2:
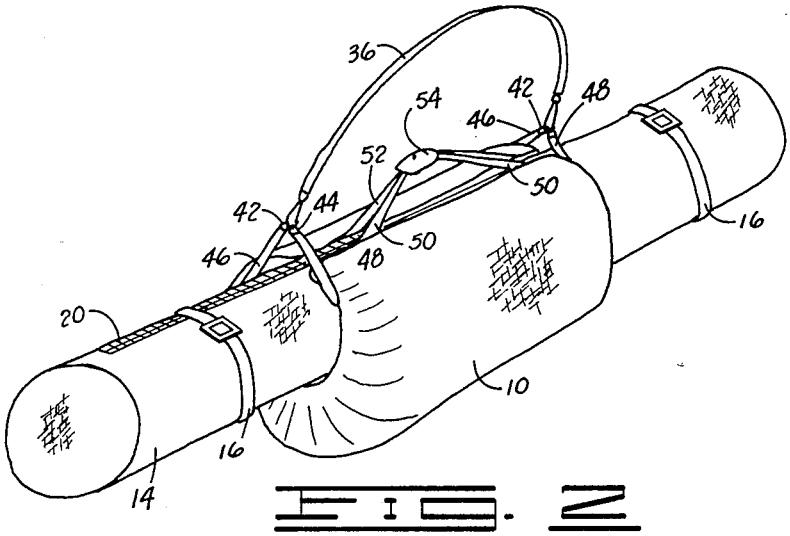
FIG. 2 is a perspective view of the combination ski and boot bag of the invention, showing the embodiment of the invention illustrated in FIG. 1 as it appears when a pair of skis is enclosed within the ski compartment and the boot compartments are utilized for containing boots. The shoulder and hand straps used for carrying the assembly are illustrated.

Referring now to FIGS. 1–6 of the drawings, one embodiment of the present invention is there illustrated. This embodiment of the combination ski and boot bag of the invention includes a flexible, external fabric duffle cover 10 which is in the form of a rectangular panel having flexible tie strings 12 at each of the four corners thereof. The duffle cover 10 is sufficiently large to reach around and encompass the boot compartments and the inwardly folded empty ski compartment when the combination ski and boot bag is in the collapsed status shown in FIG. 1.

One of the principle components of the combination ski and boot bag is an elongated generally cylindrical ski compartment 14 which is constructed of a flexible fabric material which is strong and durable, and preferably waterproof or water repellent. The ski compartment 14 is of sufficient length to accommodate a pair of skis and ski poles which are placed therein. The ski compartment carries a pair of construction straps 16 by which the skis can be kept nested with each other, and prevented from banging around loosely within the ski compartment when the combination bag is transported as hereinafter described.

For the purpose of providing access to the interior of the ski compartment 14, an elongated zipper 20 extends along the top side of this cylindrical compartment and can be zipped from the center toward one end of the compartment to open it and permit access to a pair of skis carried therein, or to permit the skis to be inserted therein. On the lower side of the central portion of the ski compartment 16, the duffle cover 10 is secured to the ski compartment 14 by a plurality of snaps 22 which can be manually engaged, and can be disengaged on occasions when it is not desired to use the duffle cover 10.

Figure 3:
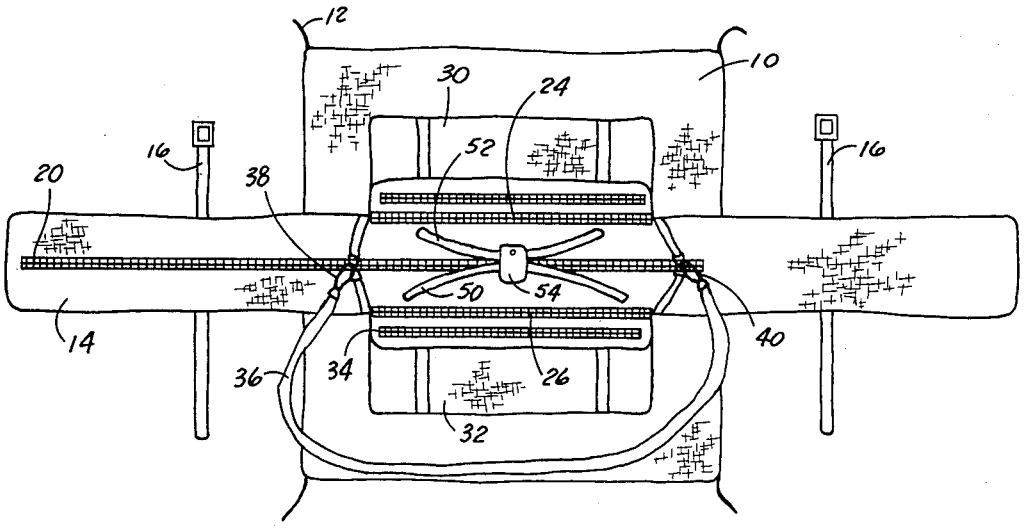
FIG. 3 is a plan view of the combination ski and boot bag shown in FIGS. 1 and 2, but illustrating the appearance of the assembly when it is laid flat on a supporting surface with the boot compartments spread outwardly from the ski compartment and the securing straps and ties in their disengaged status.
Figure 4:
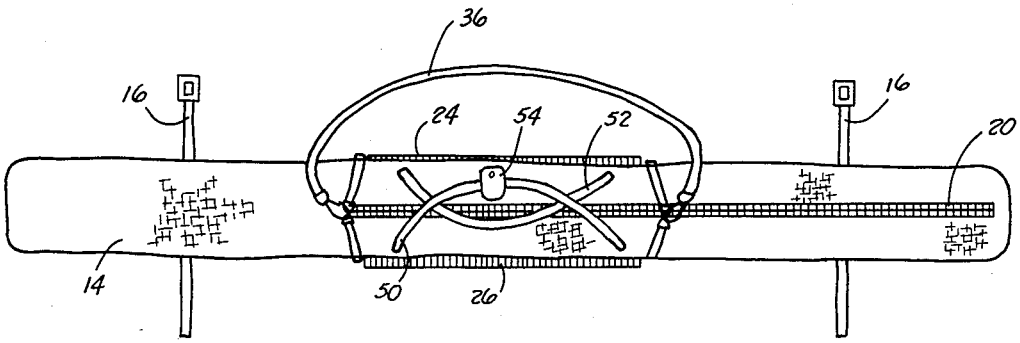
FIG. 4 is a plan view of the combination ski and boot bag illustrated in FIGS. 1–3, and showing the appearance of the bag when the boot compartments are detached and removed from the ski compartment at a time when a pair of skis is in the ski compartment.

Detachably secured to the opposite sides of the ski compartment 16 by means of quick detachable fastening elements, such as zippers 24 and 26, are a pair of substantially identically-shaped boot compartments 30 and 32. The boot compartments are also constructed of a flexible fabric material which may be a natural or a synthetic material. The boot compartments 30 and 32 are constructed so that, in a preferred embodiment, one set of zippers enables the respective compartment to be zip-engaged with the central portion of the ski compartment 14 which carries a mating and engaging zipper half on each side thereof. When the boot compartments 30 and 32 are engaged with the ski compartment 14, the two boot compartments hang down at the opposite sides of the ski compartment in the manner illustrated in FIG. 5 of the drawings. In addition to the zippers 24 and 26, each of the bag compartments carries an access zipper 34 which extends across the length of the upper side of the respective boot compartment, as perhaps as best illustrated in FIGS. 3 and 5.

In order to permit the combination ski and boot bag to be transported or carried, the assembly is provided with hand straps and a shoulder strap. The shoulder strap, denominated by reference numeral 36, carries snap clips 38 and 40 at its opposite ends. Each of the snap clips 38 and 40 is snap-engaged with a pair of D-rings 42 and 44 which are secured to the ends of a pair of divergent straps 46 and 48 secured at horizontally spaced points on the upper side of the ski compartment 14 and at locations spaced from that central portion of the ski compartment to which the two boot compartments 30 and 32 are zipper-attached. It will thus be perceived that the shoulder strap 36 can be completely detached or disengaged from the combination ski and boot bag if desired.

Figure 5:
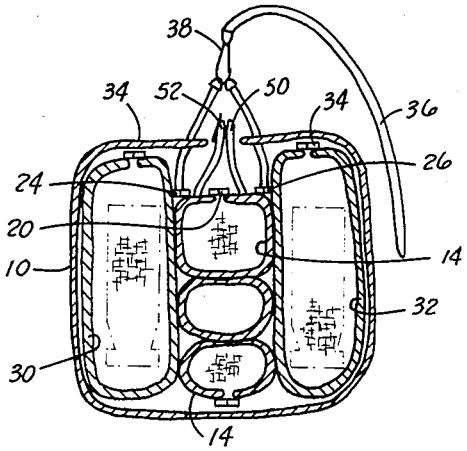
FIG. 5 is a sectional view taken through the center of the compactly folded combination ski and boot bag of the invention as the same has been folded to the appearance shown in the perspective view of FIG. 1. In this status, no skis are contained in the ski compartment, and the duffle cover is secured around the boot compartments, with one boot located in each of these compartments.
Figure 6:
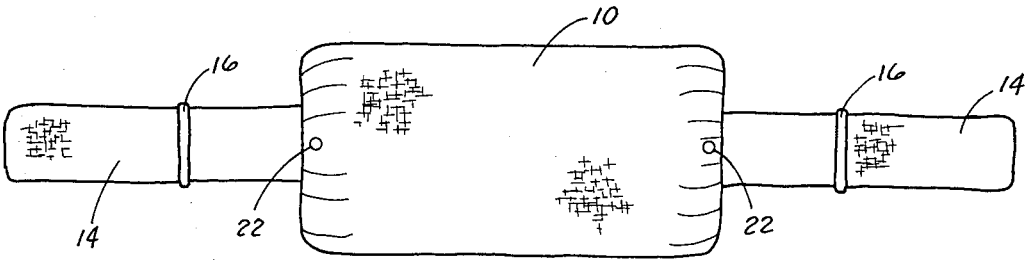
FIG. 6 is a bottom plan view of the combination ski and boot bag depicted in FIG. 2 of the drawings in which the ski compartment and the boot compartments contain skis and boots, respectively.
Figure 7:
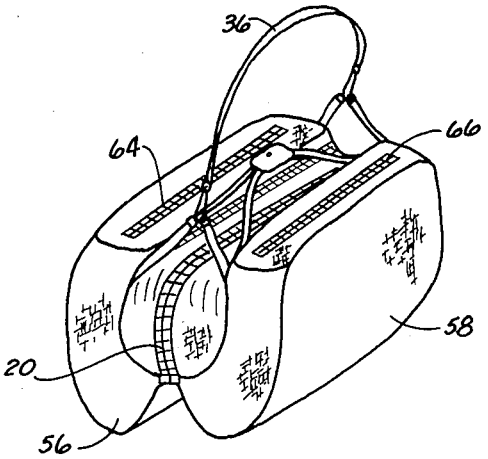
FIG. 7 is a perspective view of a different embodiment of the combination ski and boot bag of the invention showing the assembly in its folded up, compact status in which no skis have been stored in the ski compartment, and the collapsed ski compartment is folded within into the space between the two opposed, laterally-spaced boot compartments.

In addition to the shoulder strap 36, a pair of hand straps 50 and 52 centrally secured to each other by means of a hand grip pad 54 are secured to opposite sides of the ski compartment 14, as illustrated in FIGS. 1 and 5. The points of securement of the hand straps 50 and 52 are spaced inwardly from the zipper parts by which the boot bags are secured to the ski compartment. Thus, even when the boot compartments 30 and 32 are detached from the ski compartment 14, the ski compartment can still be used to carry a pair of skis stored therein, using either the shoulder strap 36 or the hand straps 50 and 52.

At a time when skis are not placed in the ski compartment 14, the elongated end portions of the ski compartment 14 can be doubled up and folded inwardly within the confines of the two boot compartments 30 and 32. The entire compact assembly is then retained in this compact status by the extension of the duffle cover 10 around the assembly and securement of the duffle cover 10 in this position by means of tie strings 12.

An alternate embodiment of the invention is illustrated in FIGS. 7–10 of the drawings. When referring to this alternate embodiment, identical reference numerals will be used in referring to identical parts in the two embodiments. The alternate embodiment of the invention includes a ski compartment 14 constructed substantially identically to that which is characteristic of the embodiment shown in FIGS. 1–6, and thus includes the elongated zipper 20. The shoulder strap 36 and hand straps 50 and 52 are also identical in the two embodiments, and are connected to the ski compartment 14 by identical connecting structures. The ski compartment 14 of the modified embodiment illustrated in FIGS. 7–9 does not carry the metallic snaps 22 to which reference has previously been made, since this embodiment of the invention does not utilize the duffle cover 10.

Figure 10:
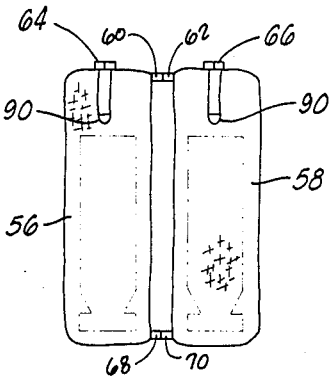
FIG. 10 is an end elevation view illustrating the two boot compartments joined to each other to form a carrying structure where the ski compartment is entirely removed in one embodiment of the invention.
Figure 9:
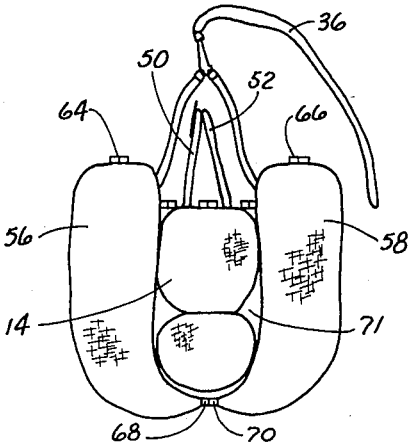
FIG. 9 is an end elevation view of the embodiment of the combination ski and boot bag depicted in FIG. 7 and, as in the case of FIG. 7, showing the collapsed ski compartment folded or tucked within the opposed boot bags when the boot bags are interconnected to form an internal space for receiving the collapsed ski compartment.

A pair of opposed, horizontally spaced boot compartments 56 and 58 are provided in the embodiment of the invention illustrated in FIGS. 7–10. The boot compartments 56 and 58 are detachably secured to the ski compartment 14 by means of zippers 60 and 62 made up of cooperating zipper halves carried respectively on the ski compartment and the two boot compartments 56 and 58. The boot compartments 56 and 58, when detached from the ski compartment, can be attached to each other by means of the two zipper halves which each carries. This provides a double compartmented, relatively short carrying case. Access to the boot compartments 56 and 58 is provided by a pair of closure zippers 64 and 66 disposed in the center of the upper side of each of the boot compartments. This arrangement is shown in FIG. 10 of the drawings. As here shown, each of the joined boot compartments 56 and 58 may also have a metal ring 90 secured thereto to facilitate securement of carrying straps.

In the embodiment of the invention illustrated in FIGS. 7–10, each of the boot compartments 56 and 58 carries on its lower, inner side, an elongated zipper half. The zipper half carried on the boot compartment 56 is denominated by reference numeral 68, and that which is carried on the boot compartment 50 is denominated by reference numeral 70. The position of the zipper halves 68 and 70 on the boot compartments 56 and 58, respectively, is such that the zipper halves can be engaged in the manner illustrated in FIGS. 7–10 to form an enclosed space 71 beneath the central portion of the ski compartment 14.

Figure 8:
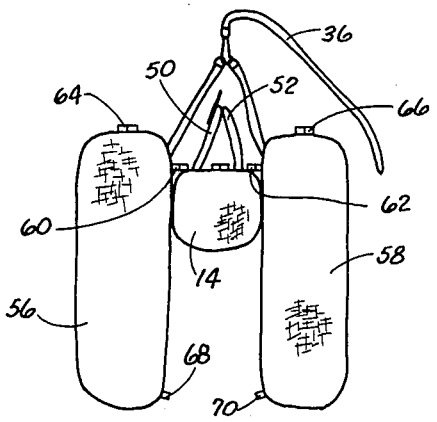
FIG. 8 is an end elevation view depicting the appearance of the alternate embodiment of the combination ski and boot bag of the invention which is illustrated in FIG. 7, and showing in this view, the appearance of the combination bag when skis are carried in the ski compartment and the two boot compartments contain boots.

At a time when a pair of boots are to be carried in the boot compartments 56 and 58 and a pair of skis are to be carried in the ski compartment 14, the appearance of the assembly looking toward one end of it is as illustrated in FIG. 8. Thus, the boot compartments 56 and 58 hang down on opposite sides of the ski compartment 14 and are substantially parallel to each other and arranged in horizontally spaced relation. The straps secured to the upper side of the ski compartment 14 facilitate carriage of the combination ski and boot bag by slinging the shoulder strap 36 over the shoulder, or by the utilization of the hand straps 50 and 52.

On occasions when skis are not to be carried, but a pair of boots or other paraphernalia is to be placed in the boot compartments 56 and 58, the elongated opposite end portions of the ski compartment 14 can be folded inwardly into the space defined above the interengaged portions of the boot compartments 56 and 58, or the boot compartments can be detached from the ski compartment and attached to each other. When the empty ski compartment is folded inwardly into this compact arrangement, the appearance of the combination ski and boot bag is that which is illustrated in FIGS. 7–10. Of course, even when there are no boots or other paraphernalia to be carried in the booth compartments 56 and 58, as well as no skis to be placed in the ski compartment 14, the compact arrangement in which the ends of the ski compartment are folded and tucked into the space between the zipper-connected boot compartments is still a means of placing the assembly in a compact form in which it can be easily stored in any small space.

If desired, the boot compartments 56 and 58 can be quickly and easily detached from the ski compartment 14 in both embodiments of the invention. This use of the combination may be occasioned where the skier is wearing his ski boots, but yet has a need to transport the skis for some distance, or it may simply occur where there is no reason to carry anything in the boot bags and the only thing needed is protection for the skis as they are carried from one place to another.

From the foregoing description of certain preferred embodiments of the invention, the basic principles upon which the invention is bottomed may be discerned by those who wish to practice the teachings of the invention. It should be pointed out, additionally, that certain variations and changes can be made in the forms of the invention which have been here illustrated and described, while still relying on the basic principles which afford great utility and marked advantage to the combination ski and boot bag of the invention. Changes and modifications of this sort which continue to rely upon and utilize the basic principles of the invention are therefore deemed to be circumscribed by the spirit and scope of the invention except as the same may be necessarily limited by the appended claims or reasonable equivalents thereof.

What is claimed is:

1. A combination ski and boot bag for concurrently transporting skis and ski boots comprising:

an elongated ski compartment for containing a pair of skis;

a pair of lateral boot compartments connected to a central portion of the ski compartment on opposite sides thereof for containing a pair of boots with one boot in each of the boot compartments disposed on opposite sides of the ski compartment;

at least one carrying strap secured to a central portion of the ski compartment for carrying the combination ski and boot bag; and means for forming and defining an enclosed space between said boot compartments for receiving end portions of said ski compartment when said ski compartment is empty whereby said combination ski and boot bag can be folded into a compact configuration both when a pair of boots are contained therein, and also when no boots or skis are contained therein.

2. A combination ski and boot bag as defined in claim 1 wherein said means for enclosing and defining a space between said boot compartments comprises a pair of zipper parts, one of said zipper parts being located on a facing portion of each of said boot compartments and said zipper parts being inter-engageable to cause said boot compartments to be drawn close to each other and enclose the space between the boot compartments at the lower side thereof while allowing open access to such space from the opposite ends of the two boot compartments.

3. A combination ski and boot bag as defined in claim 1 wherein said means for defining and enclosing said space comprises a flexible duffle cover having a central portion secured to a central portion of said ski compartment and having end portions extendable around said boot compartments and secured across said upper side thereof to form, with said boot compartments, an enclosure defining and enclosing said space between said boot compartments.

4. A combination ski and boot bag as defined in claim 1 wherein each of said lateral boot compartments is detachably connected to said central portion of said ski compartment.

5. A combination ski and boot bag as defined in claim 4 and further characterized as including a pair of zippers detachably interconnecting said boot compartments to said central portion of said ski compartment.

6. A combination ski and boot bag as defined in claim 3 wherein said duffle cover is detachable from said ski compartment.

7. A combination ski and boot bag as defined in claim 2 wherein each of said lateral boot compartments is detachably connected to said central portion of said ski compartment.

8. A combination ski and boot bag as defined in claim 3 wherein each of said lateral boot compartments is detachably connected to said central portion of said ski compartment.

9. A combination ski and boot bag as defined in claim 2 and further characterized as including a pair of zippers detachably interconnecting said boot compartments to said central portion of said ski compartment.

10. A combination ski and boot bag which comprises:

an elongated, flexible fabric tubular ski compartment for containing two skis, said compartment having a lower side and an upper side and fastening means disposed in the upper side facilitating access to the interior of the compartment;

a pair of substantially identical boot compartments disposed on opposite sides of the ski compartment and horizontally spaced from each other, each of said boot compartments including an upper side and a lower side, and having said upper side secured to a central portion of said ski compartment, and having said lower side spaced downwardly from lower side of said ski compartment;

fastening means disposed in the upper sides of the boot compartments providing access to the interior of the boot compartments;

hand-carrying straps secured to the ski compartment at the upper side thereof for carrying the combination ski and boot bag; and an elongated shoulder strap detachably secured to the ski compartment and facilitating the carriage of the combination ski and boot bag on the shoulder.

11. A combination ski and boot bag as defined in claim 10 wherein said boot compartments are each individually quick detachable from said ski compartment.

12. A combination ski and boot bag as defined in claim 10 wherein each of said boot compartments is constructed of a flexible fabric.

13. A combination ski and boot bag as defined in claim 10 and further characterized as including constricting bands around said ski compartment for holding said skis in a rested superimposed relation.

14. A combination ski and boot bag as defined in claim 10 and further characterized as including constricting bands around said ski compartment for holding said skis in a rested superimposed relation.

* * * * *

UNITED STATES PATENT AND TRADEMARK OFFICE

CERTIFICATE OF CORRECTION

PATENT NO. : 4,746,159

DATED : May 24, 1988

INVENTOR(S) : Rod P. Webb and Jean Webb

It is certified that error appears in the above-identified patent and that said Letters Patent are hereby corrected as shown below:

In Column 1, after line 19 and before line 20, please inser -a flexible storage bag which has slide fasteners located-.

In Column 1, line 44, after the word "rigid," delete th comma (,).

In Column 5, line 59, delete "50" and insert -58-.

In Column 6, line 22, delete the word "booth" and inser -boot-.

Signed and Sealed this

Twenty-fifth Day of October, 1988

*Attest:*

DONALD J. QUIGG

*Attesting Officer*

*Commissioner of Patents and Trademarks*